US005221112A

United States Patent [19]

Holmberg

[11] Patent Number: 5,221,112

[45] Date of Patent: Jun. 22, 1993

[54] METHOD AND APPARATUS FOR BINDING BOOKS

[76] Inventor: Albert E. Holmberg, 5923 Abbott Ct., Minnetonka, Minn. 55345

[21] Appl. No.: 805,535

[22] Filed: Dec. 11, 1991

[51] Int. Cl.[5] ..... B42D 1/00

[52] U.S. Cl. ..... 281/21.1; 412/8; 412/37

[58] Field of Search ..... 281/21.1, 29, 38; 412/8, 33, 37

[56] References Cited

U.S. PATENT DOCUMENTS 1,858,685 5/1932 Semon ..... 281/21.1
1,973,375 9/1934 Frazier ..... 281/21.1
2,455,971 12/1948 Bosch ..... 281/21.1
4,184,218 1/1980 Hawkes ..... 281/21.1

*Primary Examiner*—Mark Rosenbaum
*Assistant Examiner*—Willmon Fridie, Jr.
*Attorney, Agent, or Firm*—John W. Adams

[57] ABSTRACT

A method and apparatus for binding a plurality of folded sheets together by assembling the folded sheets with their fold lines in registration, clamping the assembled sheets together at the registered fold lines thereof, applying adhesive to the fold lines, and controlling the penetration of the adhesive into the areas between the clamped together registered folded edges. This permits controlling of the opening of the individual folded sheet units as well as the sheets of adjacent folded sheet units.

3 Claims, 1 Drawing Sheet

METHOD AND APPARATUS FOR BINDING BOOKS

BACKGROUND OF THE INVENTION

In the past, Applicant has developed sheet binding systems wherein folded sheets are bound together along the fold line by means of exposed pre-applied adhesive. Applicant has received two patents covering certain aspects of this concept, to wit U.S. Pat. No. 4,525,116, issued Jun. 25, 1985 and U.S. Pat. No. 4,975,011, isssued Dec. 4, 1990. One of these systems (U.S. Pat. No. 4,525,116) discloses a system for attaching a plurality of folded sheet units along the fold lines by means of a pre-applied ribbon of heat responsive adhesive and the other system (U.S. Pat. No. 4,975,011) attaching the folded sheets along the fold line by means of a solvent activated adhesive pre-applied along the fold line thereof.

In both of these prior systems, a ribbon of adhesive is pre-applied to a double sheet unit which is then folded to bisect the ribbon of adhesive and expose the same along the marginal edge portion of the fold line. This folded sheet unit forms a pair of adjacent sheets which are then connected to other similarly folded assembled sheet units by activating the exposed pre-applied adhesive, either by means of heat or by means of a solvent.

SUMMARY OF THE INVENTION

The present invention embodies the use of a folded sheet produced without any ribbon of adhesive being pre-applied thereto. The binding adhesive is applied to only the exposed V-edges of each of this assembly of folded sheets which are tightly clamped together. This forms the desired bound -together booklet, all the pages of which can be opened without restriction.

The double sheets are assembled with the V-shaped fold line edges in registration and tightly clamped together to form the binding edge of the book. Adhesive is then applied to only the exposed clamped-together V-shaped edges of the assembled sheets as by a relatively hard surfaced roller to which glue has been pre-applied.

The fact that the assembled double sheets do not have any pre-applied glue on the folded edges permits the double sheets to be tightly clamped together in adjacent side-by-side relation, to thereby prevent glue from flowing into the spaces between adjacent pairs of folded sheets. This permits all of the individual sheets of a bound book to be fully opened.

A hard surfaced glue-applying roller is provided which will flatten out the apex of the sharp "V" of the assembled fold line edges and apply glue to the slightly flattened surfaces. The amount of glue applied to the marginal edges of the apex of the "V" of each fold line can be varied by not only the pressure applied to the roller, but also by the space of the registered V-shaped edges of the assembled double sheets above the edges of the clamping jaws of the clamping mechanism.

DETAILED DESCRIPTION OF THE PREFERRED EMBODIMENT

Figure 1:
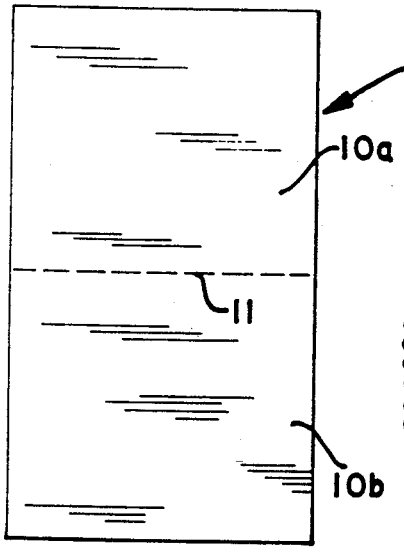
FIG. 1 is a plan view of a double sheet unit.
Figure 2:
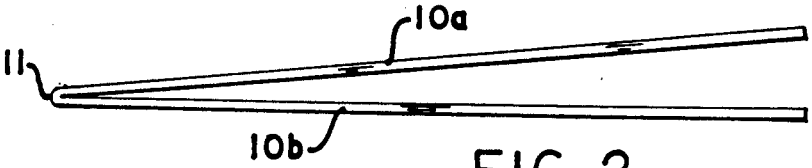
FIG. 2 is a sectional view of a single folded double sheet unit.
Figure 4:
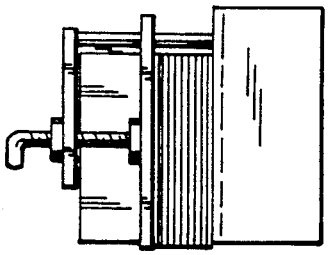
FIG. 4 is a top plan view of the clamping device with a plurality of double sheets clamped therein; and, FIG. 5 is an end elevational view of a plurality of assembled clamped together sheets to which glue is being applied.
Figure 6:
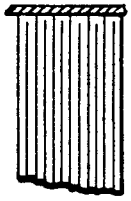
FIG. 6 is an end elevational view of a plurality of assembled clamped together sheets after glue has been applied.
Figure 5:
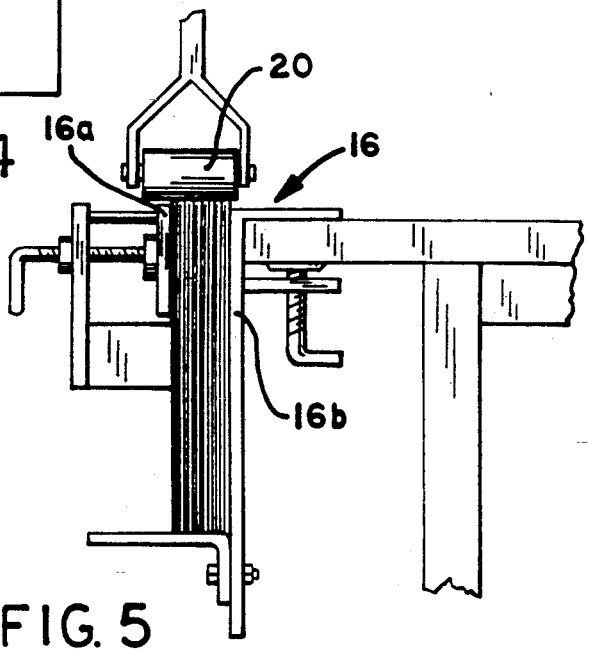

A double sheet 10 is illustrated in FIG. 1 and has a fold line 11 bisecting the double sheet into two single sheets 10*a* and 10*b*. Sheet 10 is then folded along the fold line 11 as best shown in FIG. 2, and the selected folded sheets 10*a* and 10*b* are assembled with their fold lines 11 arranged in registered aligned relationship as best shown in FIG. 3.

The assembled stacked folded sheets 10 are then interposed between a pair of jaws 16*a* and 16*b* of a clamping vise 16 with the edges 11 of the assembled sheets 10 in registration. The clamping jaws of vise 16 are then clamped together to present the registered edges in position for application of the glue. Glue is then applied by a hard-surfaced roller 20 to the clamped-together registered edges of the fold lines 11 of the assembled folded sheets 10. A suitable glue for this purpose is manufactured by Swift Adhesives, a division of Reichhold Chemical Company, Downers Grove, IL 60515, identified by Product No. 24162. The glue product is sufficiently viscous so that it will not flow into the adjacent surfaces of the clamped-together stacked folded sheet units 10. This ensures a binding connection between these folded units 10 by application of the glue to the exposed V-shaped edges of the registered fold lines 11.

Figure 3:
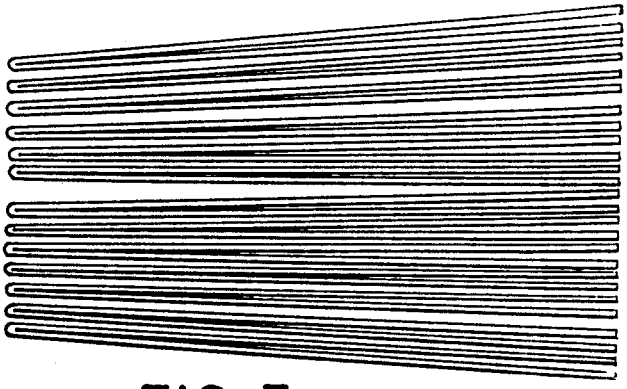
FIG. 3 is an end elevational view of a plurality of stacked folded sheets ready to be clamped together.

As shown in FIG. 3 the registered fold-line edges 11 clamped together in the clamping vise 16 are engaged by the glue-carrying surface of the roller 20. The pressure of the roller on the fold-line edges tends to flatten the edges and seal off the space between adjacent sheets and form a dam against the glue flowing between the edges. The adjacent sealed-off glued fold lines permits substantially unrestricted opening of those sheets as well as the centerfold sheet surfaces. The penetration of the glue into the marginal edge area of each folded sheet unit 10 of the clamped-together folded sheets is accurately controlled by the positioning of the assembled double sheets 10 in the vise 16 and the pressure applied by the roller 20. It will be apparent that all of the adjacent individual pages will be free to open fully substantially without restriction after the glue has dried. A suitable cover (not shown) may be applied at the bound edge in any conventional manner, either before or after the glue has dried.

What is claimed is:

1. A book comprising a plurality of paper sheets, each sheet including a fold line dividing each sheet into a double sheet unit having interior and exterior surfaces, a plurality of assembled individual double sheet units positioned to align the fold lines of each sheet unit in registration with each other along the binding edge of the book to be bound and having the assembled units tightly clamped together at the registered fold lines to prevent glue from flowing down between the registered fold lines, glue applied only to the registered fold line edges of each folded sheet, forming a glue plane perpendicular to the planes defined by the registered fold line marginal edge portions of the double sheets to secure the fold lines together and form a bound book capable of being fully opened between the adjacent double sheet units as well as between the interior surfaces of the folded double sheet units.

2. The structure set forth in claim 1 wherein each double sheet unit comprises the same sized sheets.

3. The method of binding a plurality of sheets together comprising, providing a plurality of individual sheets each having a fold line dividing the same into a pair of connected double sheet units each having interior and exterior surfaces, assembling a plurality of the folded individual double sheet units with the fold line edges in registration with each other to form a glue plane defining a binding edge of the book to be bound, clamping the assembled double sheet units together adjacent the glue plane to substantially eliminate space between the registered adjacent sheet units at said glue plane defined by the registered fold line marginal edge portions of the double sheet units of the assembled clamped-together sheet units, and applying glue to the clamped-together edges forming the glue plane formed by the clamped-together registered fold line edges of the assembled sheets, controlling flow of glue to substantially prevent the glue from flowing into the marginal sheet areas between adjacent fold line edges whereby the assembled sheets are held together by the glue applied to only the exposed clamped-together fold line edges, permitting all of the adjacent sheets to be fully opened substantially without restriction.

* * * * *